United States Patent [19]

Dunn

[11] Patent Number: 4,480,345

[45] Date of Patent: Nov. 6, 1984

[54] BREAK-AWAY SCOOP STRETCHER

[75] Inventor: Robert E. Dunn, Washington Court House, Ohio

[73] Assignee: Ferno-Washington, Inc., Wilmington, Ohio

[21] Appl. No.: 395,722

[22] Filed: Jul. 6, 1982

[51] Int. Cl.[3] ..... A61G 1/00

[52] U.S. Cl. ..... 5/82 R; 5/111; 5/114

[58] Field of Search ..... 5/81 R, 82 R, 83, 89, 5/111, 114; 403/100, 102

[56] References Cited

U.S. PATENT DOCUMENTS

| | | | |
|---|---|---|---|
| 713,405 | 11/1902 | Crawford | 5/82 |
| 795,524 | 7/1905 | Leffmann | 5/89 |
| 1,326,931 | 1/1920 | Himes | 403/100 |
| 2,242,311 | 5/1941 | Lucey | 5/82 |
| 3,597,773 | 8/1971 | Firestone | 5/82 |
| 3,653,079 | 4/1972 | Bourgraf et al. | 5/82 |

FOREIGN PATENT DOCUMENTS

| | | | |
|---|---|---|---|
| 296279 | 8/1928 | United Kingdom | 5/82 |

*Primary Examiner*—Alexander Grosz
*Assistant Examiner*—Michael F. Trettel
*Attorney, Agent, or Firm*—Frost & Jacobs

[57] ABSTRACT

An adjustable break-away stretcher having a pair of complimentary frame parts detachably interconnected at each end, the frame parts including a body section and an extensible leg section each mounting aligned patient supporting panels, the extensible leg section having cylindrical tubular frame members telescopically received in polygonal tubular members in the body section, the polygonal frame members having mating polygonal plugs at their ends adapted to be slidably but non-rotatably received in the polygonal tubes so as to prevent the tubular frame members from rotating relative to the body section, the arrangement preventing misalignment between the patient supporting panels of the leg section relative to those of the body section when the frame parts are detached and, where locking pins are used to fix the position of the extensible leg section relative to the body section, misalignment of the locking pins relative to the openings in which they are received is also prevented. The extensible tubular frame members are preferably connected to the polygonal plugs by hinges which normally lie within the confines of the polygonal tubes but which project outwardly beyond the ends of the tubes when the extensible section is extended, thereby permitting the extensible section to be folded relative to the body section. The locking pins are controlled by latch arms which are movable from a retracted to an extended position in which they provide an easily ascertainable visual indication of whether the locking pins are in locked or unlocked position.

7 Claims, 8 Drawing Figures

BREAK-AWAY SCOOP STRETCHER

This invention relates to break-away or splint stretchers of the type wherein the stretcher frame is composed of opposing parts which are detachably interconnected at their opposite ends, thereby permitting the stretcher to be separated into opposing parts which may be readily fitted beneath an injured person and reassembled with the patient supported on the stretcher.

BACKGROUND OF THE INVENTION

The present invention relates to an improvement in the type of break-away stretcher disclosed in U.S. Pat. No. 3,653,079 wherein the stretcher frame is formed from aluminum tubing which mounts aligned pairs of body, head and leg supporting panels which also may be formed from aluminum. In stretchers of this character, the leg supporting section of the stretcher frame is preferably extensible so that the length of the stretcher may be varied in accordance with the height of the person being carried. To this end, the leg section of the stretcher frame, which is formed from tubing, is adapted to be telescopically received within tubular members forming a part of the body section of the stretcher frame, locking pins being provided on the body section of the stretcher which selectively engage in spaced apart openings in the extensible frame members of the leg section to vary the length of the stretcher in accordance with the size of the patient.

While scoop stretchers of the character described are in widespread use, difficulties have been experienced in maintaining proper alignment between the patient supporting panels of the extensible section and those of the body section. This is due to the fact that when the opposing sides of the stretcher are disconnected, the tubular leg members of the extensible frame section are free to rotate relative to each other, such rotation resulting in misalignment of the patient supporting panels. The problem is magnified by the use of locking pins to secure the leg section, rotation of the leg members also resulting in lateral misalignment of the locking pins with respect to the openings in which they are to be received. While in either event such misalignment can be corrected by rotating the parts until proper alignment is achieved, such manipulation is time consuming and particularly undesirable in an emergency situation when rescue personnel are under considerable stress and time is of the essence in carrying out the rescue operation.

The present invention overcomes the foregoing difficulties by providing an improved stretcher construction wherein the telescoping frame members, while movable axially relative to each other, cannot be rotated so as to misalign the support panels; and if locking pins are used, misalignment of the locking pins relative to the opening in which they are adapted to be received is also prevented.

SUMMARY OF THE INVENTION

In accordance with the invention, means are provided to prevent relative rotation between the axially movable frame members forming the leg section of the stretcher and the members in which they are slidably received. In the preferred embodiment of the invention, the frame members of the leg section are formed from cylindrical tubing, as are the other exposed frame members of the stretcher. Cylindrical frame members are preferred in that they permit the stretcher to be gripped at any desired location.

The body supporting section of the stretcher frame includes longitudinally extending frame members adapted to telescopically receive the frame members defining the leg section of the stretcher, but in this instance the frame members which telescopically receive the frame members of the leg section, while hollow, are essentially square in cross-section and of a size to slidably receive the cylindrical tubing of the leg section therein. Other cross-sectional shapes, such as rectangular, triangular, or hexagonal may be used, and such shapes will be collectively referred to as polygonal tubing. In order to prevent relative rotation between the cylindrical tubing of the foot section and the polygonal tubing of the body section, plugs which are of like polygonal cross-section are fixedly secured to the innermost ends of the cylindrical tubing members of the leg section, the cross-sectional dimensions of the plugs being such that they will be snuggly yet slidably received within the polygonal tubular members of the body section. With such arrangement, the cylindrical tubes of the foot section are slidable longitudinally relative to the polygonal tubular members in which they are received, but due to the mating polygonal plugs, the cylindrical tubular members cannot rotate and hence the patient supporting panels of the leg section will remain at al times in proper alignment with the patient supporting panels of the body section. In like manner the openings in the cylindrical frame members of the leg section will be aligned with the locking pins mounted on the ends of the body section, and they will remain in proper alignment in that there can be no relative rotation between the telescoping parts.

In a preferred embodiment of the invention, the cylindrical tubular frame members of the leg section are interconnected to the plugs by means of pivot hinges which, when the leg section is in a fully extended position, permit the leg section to be folded over and seated against the body section of the stretcher frame to thereby reduce the overall length of the stretcher for storage purposes.

To facilitate the mounting of the polygonal tubing, the body section of the stretcher is provided with ribs at least at its opposite ends, which ribs define the contour of the body supporting panels, such ribs having integral sockets or bores which receive the frame members. In the case of the cylindrical frame members of the leg section, the sockets are of open ended cylindrical configuration and of a size to snugly but slidably receive the cylindrical frame members of the leg section therein. The polygonal tubing of the body section is received between an opposing pair of shoulders formed on the inner surface of each rib, the shoulders effectively forming a socket in which the polygonal tubing is received and held against rotation.

The invention also contemplates the provision of an improved locking pin arrangment which facilitates the rapid disengagement of the locking pins when adjustment of the leg section is required, the position of the latch arms of the locking pins providing a ready indication as to whether or not the locking pins are in engagement with the frame members of the leg section.

DESCRIPTION OF THE PREFERRED EMBODIMENT

Figure 1:
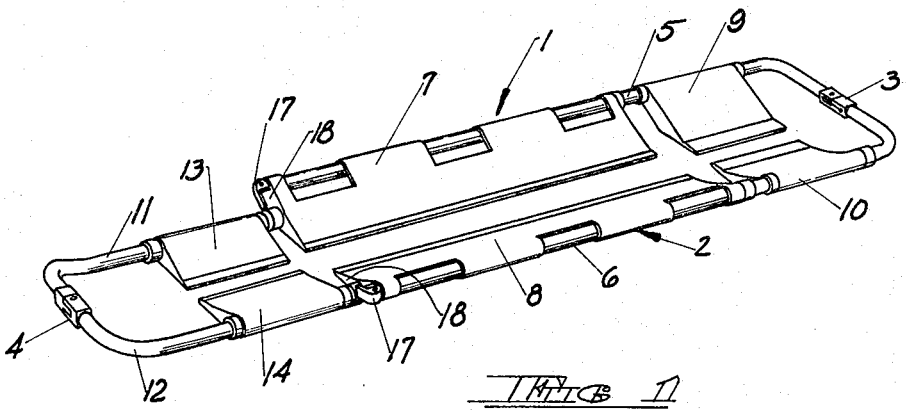
FIG. 1 is a perspective view of a break-away stretcher in assembled condition.
Figure 2:
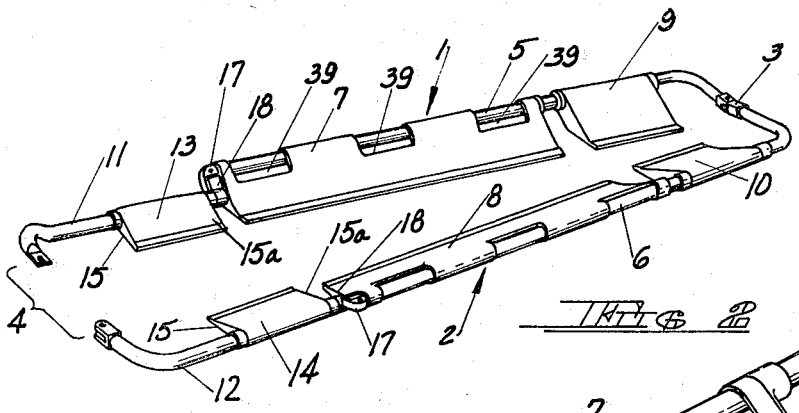
FIG. 2 is a perspective view of the stretcher with opposing sides of the stretcher pivoted outwardly relative to each other.

Referring first to FIGS. 1 and 2 of the drawings, the stretcher comprises complimentary frame parts 1 and 2 interconnected at their opposite ends by pivot locks 3 and 4 which may be selectively disengaged to separate the opposing frame parts 1 and 2 in the manner illustrated in FIG. 2 wherein the pivot lock 4 has been separated to permit the parts 1 and 2 to be pivoted outwardly about the pivot lock 3. The pivot locks preferably will be of the type disclosed in the aforementioned U.S. Pat. No. 3,653,079 and also in U.S. Pat. No. 3,801,208.

In the embodiment illustrated, the tubular frame members 5 and 6 mount the body supporting panels defining the body section of the stretcher and the head supporting panels 9 and 10 which define a head section integral with the body section. The leg section is defined by extensible tubular members 11 and 12 mounting leg supporting panels 13 and 14, respectively.

Figure 3:
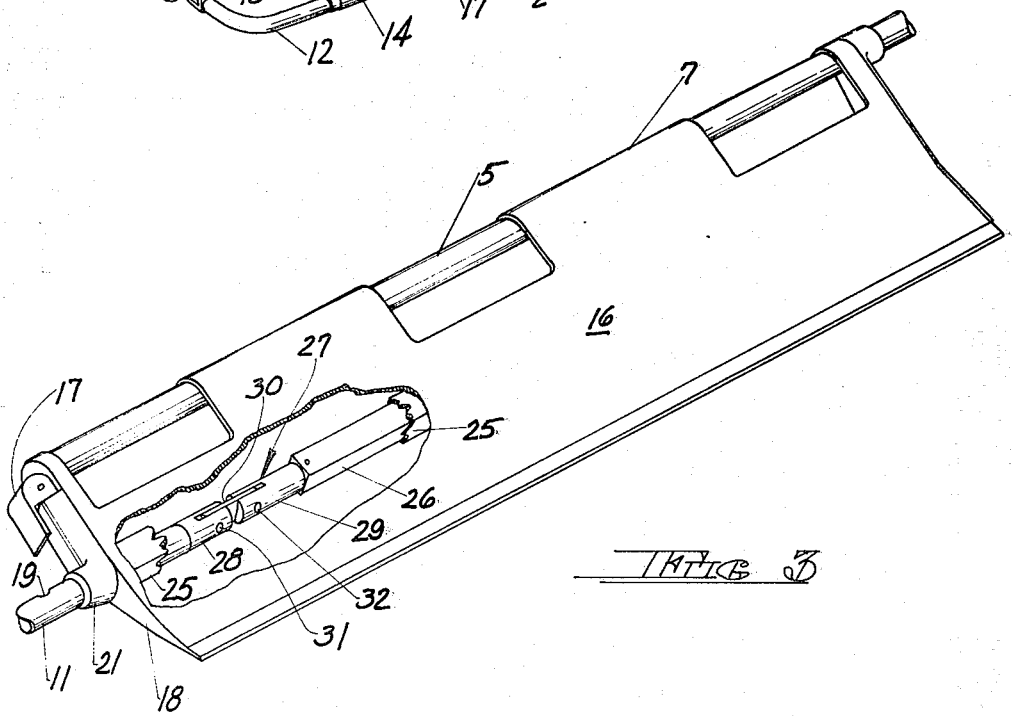
FIG. 3 is an enlarged fragmentary perspective view with parts broken away illustrating one side of the body section of the stretcher and the means for preventing relative rotation between the body section and the frame members of the leg section.

The various supporting panels 7–14 are preferably formed by sets of ribs, such as the ribs 15, 15*a* at the opposite ends of the leg supporting panels, the ribs being fixedly secured to the tubular frame members and covered by a skin of aluminum sheeting, such as the sheeting 16 seen in FIG. 3. The number of ribs supporting each panel will depend upon the length of the panel and the need for intermediate support. As will be evident from the drawings, the supporting panels taper inwardly and are contoured so that the complimentary frame parts may be readily fitted beneath the patient.

The extensible tubular members 11 and 12 are disposed inwardly with respect to the side frame members 5 and 6 and are telescopically received within the body supporting panels 7 and 8, locking fixtures 17 being mounted on the ribs 18 at the leg ends of body supporting panels 7 and 8, the locking fixtures serving to selectively lock the extensible frame members 11 and 12 in the desired position of use.

In accordance with the present invention, an arrangement is provided whereby the extensible tubular members 11 and 12 are prevented from rotating relative to the ribs 18 of the body forming panels 7 and 8, thereby assuring accurate alignment of the leg supporting panels 13 and 14 relative to the body supporting panels 7 and 8, respectively. Such arrangement also provides accurate alignment of the spaced apart openings in the extensible frame members, one of which is seen at 19 in FIG. 3, with respect to the locking pins 20 (seen in FIGS. 4 and 5) of the locking fixtures 17.

Each of the ribs 18, which are preferably in the form of aluminum castings, is provided with an external socket 21 having a cylindrical bore 22 of a size to slidably receive the extensible tubular leg members, such as the leg member 11. The opposite, or inner side, of the rib 18 is provided with a pair of opposing shoulders 23 and 24 lying on opposite sides of the bore 22, the shoulders effectively defining a square socket adapted to receive the adjoining end of the polygonal tubing 20 which extends lengthwise of the body supporting panel 7 in axial alignment with bore 22 and extensible leg member 11, the tubing 25 in this instance being square in cross-section, having a cross-sectional dimension slightly larger than the outside diameter of the extensible member 11 so that the latter will be slidably received therein. A square plug 26 is slidably received in the square tubing 25, the cross-sectional dimensions of the plug being such that it is held against rotation relative to the square tube 25.

Figure 8:
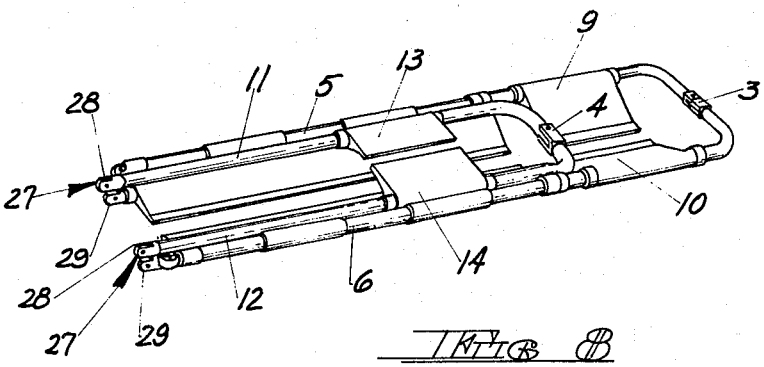
FIG. 8 is a perspective view illustrating the manner in which the foot section may be extended and folded over the body section of the stretcher for storage purposes.

It is essential that the tubular member 11 is non-rotatably secured to the plug 26, which may be accomplished by pinning the tubular member directly to the plug, although in a prefered embodiment of the invention the tubular member 11 is secured to the plug 26 by means of a hinge 27, as seen in FIG. 3, the hinge having opposing bifurcated parts 28 and 29 interconnected by a tongue 30 the opposite ends of which are received in and pivotally connected to the bifurcated parts 28 and 29 by the pivot pins 31 and 32, respectively. As will be evident, the tongue 30 will prevent relative rotation between the opposing parts 28 and 29 and hence between members 11 and 26 which they interconnect. However, when the tubular member 11 is extended to a position wherein the hinge 27 lies outwardly beyond the external socket 21 of rib 18, the leg section may be pivoted to overlie the body section, in the manner illustrated in FIG. 8. In this connection, the polygonal plug 26 will prevent complete withdrawal of the extensible tubular member 11 from the body section, the plug seating against the inner surface of the rib 18 in areas surrounding the cylindrical bore 22.

Figures 4, 5, 6:
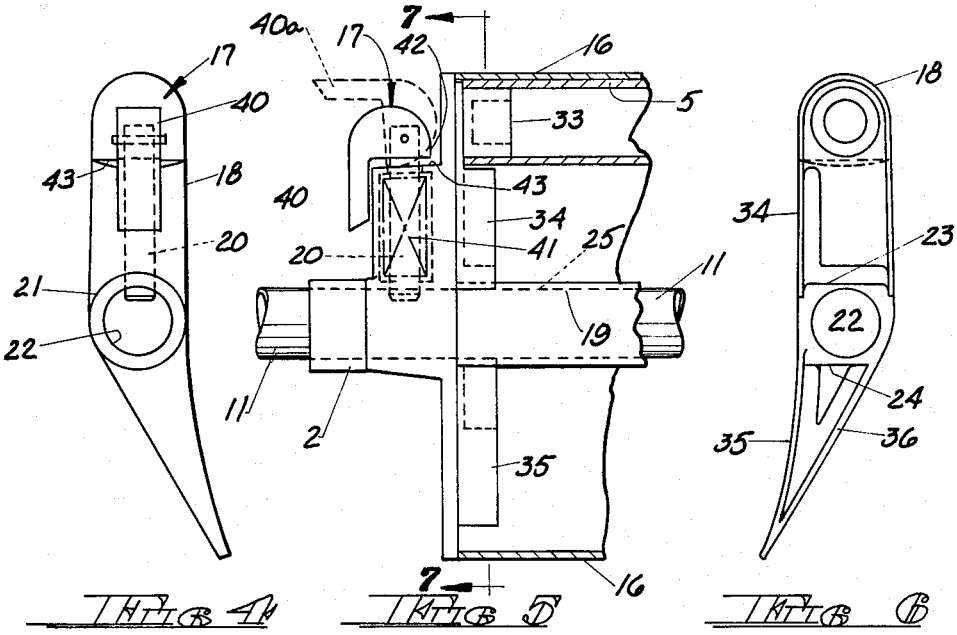
FIG. 4 is an end elevational view from the outside of the rib at the leg end of the body section.
FIG. 5 is a side elevational view of the rib, including adjoining portions of the body section.
FIG. 6 is an end elevational view of the inner surface of the rib.
Figure 7:
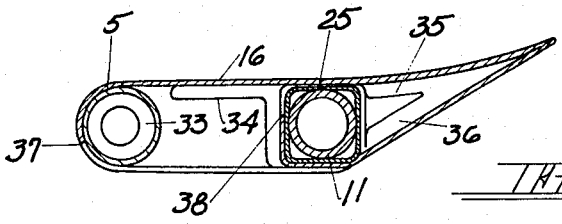
FIG. 7 is a sectional view taken along the line 7—7 of FIG. 6.

As will be evident from FIGS. 5, 6 and 7, the inner surface of the rib 18 is provided with an annular stud 33 adjacent its outermost end to receive the end of tubular frame member 5 which will be affixed thereto. In addition, the rib is provided with peripheral supporting surfaces 34, 35 and 36 which form seats for the marginal end edges of the sheeting skin 16 which covers the body supporting panels. While the sheeting may fully cover both sides of the panels, a savings in sheeting may be realized only partially covering the undersurface of the panels. As seen in FIG. 7, the sheeting 16 may extend partially around the tubular frame member 5, terminating at point 37; and similarly, the sheeting may pass beneath square tube 25 and extend upwardly along its inner side edge, terminating at the point 38. While the formed sheeting will be self-sustaining, it is preferred to secure it to the peripheral supporting surfaces of the rib by one or more pop rivets. It also may be noted from FIGS. 1 and 2 that in the case of the body supporting panels 7 and 8, it is preferred that they are provided with spaced apart hand-hole openings 39 so that the stretcher bearers may conveniently grip the tubular frame members to carry the stretcher from its opposite sides.

Referring again to FIGS. 4 and 5, the latch fixture 17 has been improved in order to afford the stretcher bearer with a visual indication of the condition of the locking pins, i.e., whether they are engaged or disengaged. Heretofore the locking pins were displaced by a camming action upon rotation of the latch knobs and it was found difficult for the stretcher bearers to quickly ascertain whether or not the locking pins were engaged. In the present embodiment, the locking pin is connected to a locking finger 40 which may be pivoted from the locked position shown in solid lines to the unlocked or extended position shown in dotted lines at 40*a* in FIG. 5. A spring, diagrammatically indicated at 41, normally biases the locking pin 20 inwardly to the locked position in which it engages in one of the openings 19. The locking pin is displaced by pivoting the locking finger 40 to its extended position 40*a*, such movement causing the locking pin to be cammed upwardly as the edge 42 of the locking finger pivots into contact with the underlying surface 43 forming a part of the rib 18, such movement of the locking finger causing the locking pin to be displaced upwardly against the compression of spring 41. Thus, the extended position of the locking finger gives the stretcher bearer an immediate indication that the leg section is not locked in place.

As should now be evident, the present invention provides an improved stretcher construction incorporating means for maintaining accurate alignment between the supporting panels mounted on the extensible tubular members of the leg section and the supporting panels on the body section of the stretcher. Where locking pins are utilized to secure the extensible section relative to the body section, the locking pins are also maintained in accurate alignment with the openings in which they are received. The construction of the locking fixtures is such that the stretcher bearers may readily ascertain whether or not the leg section is properly locked in place, and additionally the construction permits the leg section to be extended and folded relative to the body section for convenience in storage. While pin type locking fixtures are preferred, it will be apparent that other forms of locking mechanisms may be used to fix the position of the extensible tubular members of the leg section relative to the body section.

What is claimed is:

1. In a break-away stretcher having a pair of complimentary frame parts detachably interconnected at each end by pivot means so that the complimentary parts may be detached, fitted beneath a patient from opposite sides and reattached with the patient supported on the stretcher, said frame parts including a body section and an extensible section having cylindrical tubular frame members telescopically received in the body section so that the length of the stretcher may be adjusted, each of said sections including aligned pairs of scoop-like patient supporting panels, the patient supporting panels of said extensible section being secured to said cylindrical tubular frame members, and locking means for maintaining said extensible section in a selected position of use relative to said body section in accordance with the size of the patient being carried, the improvement comprising polygonal tubes in said body section positioned to telescopically receive the cylindrical tubular frame members of said extensible section, and polygonal plugs non-rotatably affixed to the ends of the cylindrical tubular frame members inserted in said polygonal tubes, said plugs being of a size to be slidably but non-rotatably received in said polygonal tubes, whereby rotation of the tubular frame members of the extensible section relative to said body section is prevented when said locking means are disengaged and at least one end of the pair of complimentary frame parts is separated, and the patient supporting panels of the extensible section will be maintained at all times in proper alignment with the patient receiving panels of said body section irrespective of relative movement between the extensible section and the body section.

2. The break-away stretcher claimed in claim 1 wherein said locking means comprise locking pins mounted on said body section and positioned to selectively engage a plurality of spaced apart aligned openings extending lengthwise along said tubular frame members of said extensible section, including latch means for displacing said locking pins, said latch means comprising latch arms movable from a retracted to an extended position to provide an easily ascertainable visual indication of whether the locking pins are in locked or unlocked position.

3. The break-away stretcher claimed in claim 1 or claim 2 including hinge means interconnecting the ends of the cylindrical tubular members of said extensible section and said polygonal plugs, whereby said extensible section may be folded relative to said body section when said extensible section is in an extended position relative to said body section.

4. The break-away stretcher claimed in claim 1 wherein said polygonal tubes and said complimentary polygonal plugs are essentially square in cross-section.

5. The break-away stretcher claimed in claim 1 wherein the supporting panels of said body section have contoured ribs which define the cross-sectional shape of said supporting panels, and a covering on said ribs, said polygonal tubes lying within the confines of said ribs and said covering.

6. The break-away stretcher claimed in claim 5 wherein the supporting panels of said body section have ribs at their opposite ends, and wherein the inner surfaces of the ribs at the ends of the supporting panels adjoining said extensible section have non-rotatable socket means thereon for engaging and fixedly securing said polygonal tubes to said last named ribs, and wherein the outer surfaces of said last named ribs have socket means thereon defining a cylindrical bore of a size to slidably receive the cylindrical tubular frame members of said extensible section.

7. The break-away stretcher claimed in claim 6 wherein said body section includes cylindrical tubular frame members defining the outermost side edges of said supporting panels, wherein said covering comprises aluminum sheeting, said sheeting following the contour of said ribs and having one side edge at least partially wrapped around said last named cylindrical tubular frame members and the opposite side edge wrapped at least partially around said polygonal tubes.

* * * * *